166-68 SR
7/30/85 OR 4,531,579

United States Patent [19]
Larronde et al.

[11] Patent Number: 4,531,579
[45] Date of Patent: Jul. 30, 1985

[54] VALVE LATCH DEVICE FOR DRILLING FLUID TELEMETRY SYSTEMS

[75] Inventors: Michael L. Larronde, Houston; Robert G. Hoos, Porter, both of Tex.

[73] Assignee: NL Industries, Inc., New York, N.Y.

[21] Appl. No.: 461,649

[22] Filed: Jan. 27, 1983

[51] Int. Cl.³ ..... E21C 7/06
[52] U.S. Cl. ..... 166/66; 175/48; 251/89; 251/137
[58] Field of Search ..... 175/40, 45, 50, 48; 166/66; 251/89, 137, 327-329; 367/81-85

[56] References Cited

U.S. PATENT DOCUMENTS

| | | | |
|---|---|---|---|
| 2,236,145 | 3/1941 | Kolb | 251/89 |
| 2,842,334 | 7/1952 | Short | 251/137 |
| 2,869,475 | 1/1959 | Bobo | 251/89 |
| 4,078,620 | 3/1978 | Westlake et al. | 175/48 |

FOREIGN PATENT DOCUMENTS

| | | | |
|---|---|---|---|
| 14466 | of 1912 | United Kingdom | 251/89 |

*Primary Examiner*—William F. Pate, III
*Attorney, Agent, or Firm*—Browning, Bushman, Zamecki & Anderson

[57] ABSTRACT

A latch device for controlling a valve in a mud pulse telemetry system for imparting data pulses to drilling fluids circulating in a drill string is disclosed. A latch device and valve arrangement including an improved shear type, solenoid operated valve for modulating the pressure of the circulating drilling fluid is disclosed. A latching solenoid armature is connected to the valve gate through separate open and close solenoids having their armatures operatively connected to act as a single unit. The single unit armature is normally restrained from movement by the solenoid deactivated latch device. The latch device is arranged so that the vibrational and impact loads on the drill string serve to further maintain the modulating valve in a closed position.

24 Claims, 6 Drawing Figures

FIG. 4
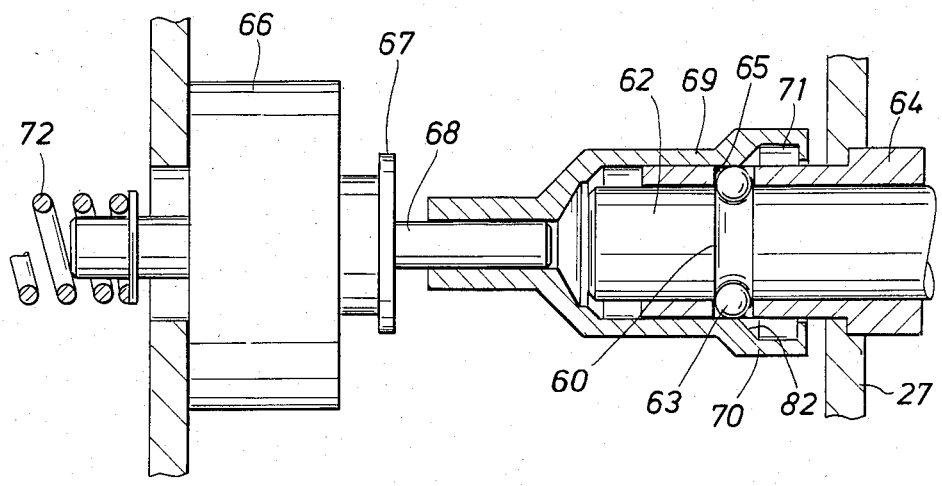
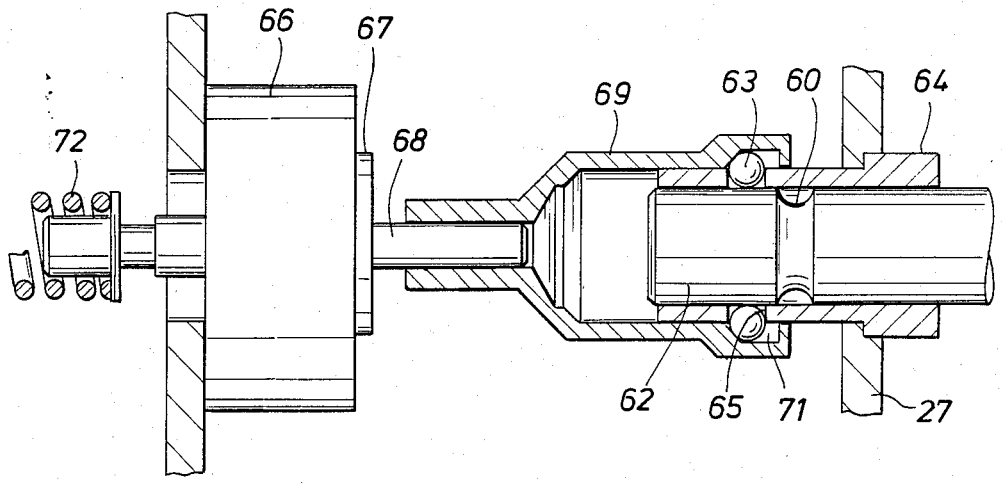
FIG.3

FIG. 6
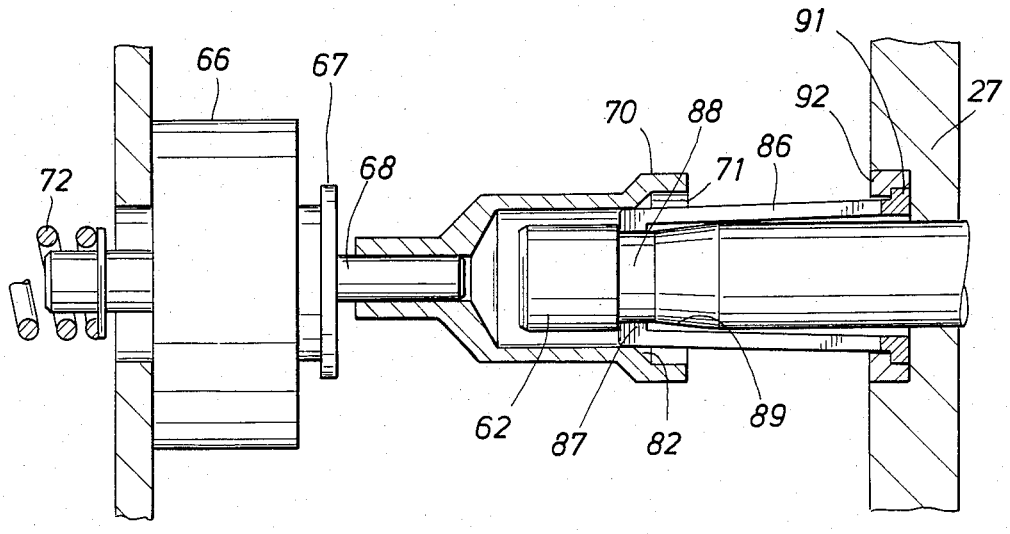
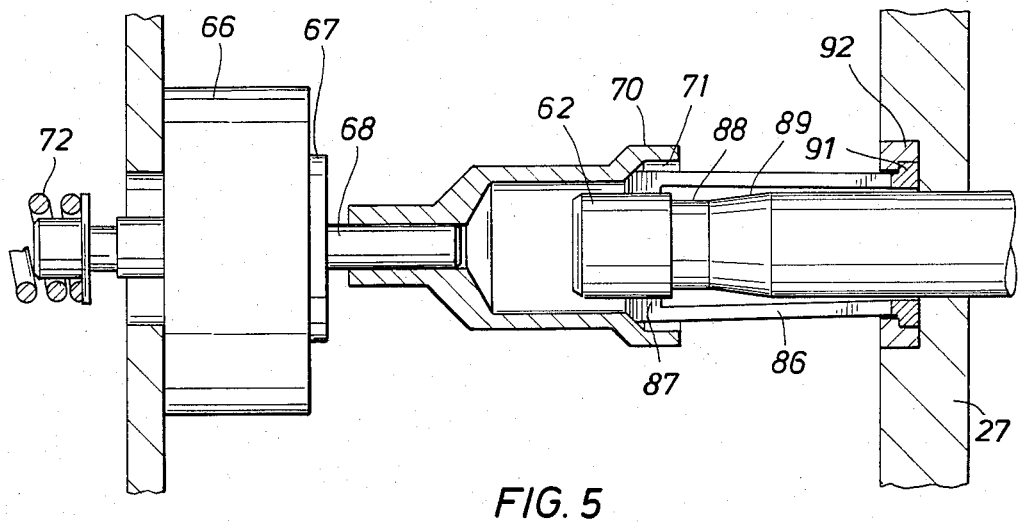
FIG. 5

VALVE LATCH DEVICE FOR DRILLING FLUID TELEMETRY SYSTEMS

BACKGROUND OF THE INVENTION

1. Field of the Invention

The present invention relates to a drilling fluid telemetry system and, more particularly, to a latch device for controlling a valve for modulating the pressure of a drilling fluid circulating in a drill string in a well bore.

2. Description of the Background

Drilling fluid telemetry systems, commonly referred to as mud pulse systems, are particularly adapted for telemetry of information from the bottom of a borehole to the surface of the earth during oil well drilling operations. The information telemetered often includes, but is not limited to, parameters of pressure, temperature, salinity, direction and deviation of the well bore, bit conditions and logging data, including resistivity of the various layers, sonic density, porosity, induction, self potential and pressure gradients.

In previous borehole telemetry systems, it was first necessary to pull up the drilling pipe section by section including the drilling bit to completely vacate the drilled hole prior to making measurements of important parameters at the bottom of the borehole. Sensors were then lowered down to the bottom of the well on a wireline cable, the measurements were taken, the sensors and wireline were removed and finally the bit and drilling pipe was reassembled and put back into the hole. Obviously, such procedures were extremely expensive and time consuming as a result of the cessation of drilling operations during measurement times.

These problems have led to research in borehole telemetry systems in which the drilling pipe and bit do not have to be removed from the well before measurements are made. Attempts have been made to telemeter data by means of sonic waves traveling through either the drilling pipe or through the drilling mud present both inside and surrounding the drilling pipe. Unfortunately, the drilling mud is a strong sonic damping medium and substantially attenuates the sonic waves before they can travel a usable distance. Acoustic systems using the drill pipe as the conductor require the use of repeater subs in the pipe string and are electrically complicated. No commercial acoustic system has yet been developed. Total useful telemetry depth with these systems is less than minimally needed in a practical operation.

Other proposed systems have employed an electrical conductor installed either inside or outside the drill pipe or the casing pipe. Unfortunately, the physical forces encountered in a borehole drilling operation inside the well bore and the cuttings and other debris brought up from the bottom of the well bore often result in malfunctions in the conductors and associated electrical connectors.

Another proposed system utilizes a conductor inside of each section of drill pipe with transformer coupling between sections of pipe. Besides requiring expensive modifications to the drill pipe, these systems are unreliable because the magnetic coupling between sections is frequently hindered by mechanical misalignment between drill pipe sections and because the alignment of coupling coils with one another is difficult to achieve.

Still other proposed systems employ either the drilling pipe or casing pipe as one of the conductors in an electrical transmission system. The earth itself may form the other conductor. Unfortunately, the conductivity of the earth is unpredictable and is frequently too low to make this a system practical at typical borehole depths. Still further, these systems often include a single wire along the casing pipe or drilling pipe. These systems suffer from the problems discussed above with the hard-wire systems. Both of these systems suffer the additional common problem that the conductivity between pipe sections is greatly affected by the presence of contaminants on the pipe joints. Frequently the resistance of the pipe joints is too high to permit telemetry using any practical power levels.

Still other proposed systems involve various electromagnetic transmission schemes for directing electromagnetic signals up the pipe string to the surface, either through the pipe or mud. These systems, similar to the sonic systems discussed above, are complicated by attempts to overcome the attenuating affects of these transmitting mediums.

At present the only drill string telemetry systems which have achieved commercial success are those related to mud pulse telemetry. One example of such a prior mud pulse system is illustrated in U.S. Pat. No. 3,964,556 which requires that circulation of drilling fluids be ceased in order to operate the system. Other systems have used a controlled restriction placed in the circulating mud stream and are commonly referred to as positive pulse systems. With mud volume sometimes surpassing 600 gpm and pump pressures exceeding 3000 psi, the restriction of this large, high pressure flow requires very powerful downhole apparatus and energy sources. Further, these systems must deal with the movement of valve parts under high pressure conditions, resulting in a source of problems dealing with the durability of valve parts subjected to high pressure, abrasive, fluid flow conditions.

A presently employed mud pulse system involving negative pressure pulse techniques includes a downhole valve for venting a portion of the circulating drilling fluids from the interior of the drill string to the annular space between the pipe string and the borehole wall. As drilling fluids are circulated down the inside of the drill string, out through the drill bit and up the annular space to the surface, a pressure of about 1000 to about 3000 psi is developed across the drill bit. Thus, a substantial pressure differential exists across the wall of the drill string above the drill bit. By momentarily venting a portion of the fluid flow out a lateral port, above the bit, in the drill string, a momentary pressure drop is produced at the surface and is detectable to provide a surface indication of the downhole venting. A downhole instrument or detector is arranged to produce a signal or mechanical action upon the occurrence of a downhole detected event to produce the abovedescribed venting. As may be readily appreciated by those skilled in the art, the sophistication to which this signalling may be developed is practically unlimited.

A major problem associated with negative pressure pulse systems is the wear and replacement of valve parts, particularly as the data rate is expanded. It is highly desirable to operate such a system as long as possible since replacement of system components typically requires the time consuming and expensive removal of the valve system from its downhole location and from the drill string at the surface. One negative pulse system uses a poppet valve having a circuitous flow path through the valve. The seat of the poppet is worn rapidly by the high rates of abrasive fluid flow when the valve is in the open position. In addition, it is desirable to have a fast acting opening and closing movement of the valve parts in order to create a sharp pressure pulse for adequate detection at the surface. Rapid closing of the poppet valve generates a high valve head impact force on the seat. This force rapidly wears the valve parts, particularly when abrasive particles are present in the fluid flow through the valve. Such particles become impacted in the valve parts and deteriorate the sealing surfaces of the valve. The repeated impact forces may also break portions of the valve parts because erosion resistant materials are generally not impact resistant.

Another negative pulse system employs a rotary acting valve which as a result of the mass of rotary valve parts and the motor system used to operate the valve is a slow acting system.

These examples illustrate some of the crucial considerations that exist in the application of a rapidly acting valve to a fluid flow to generate a sharp pressure pulse. Other considerations in the use of these systems in borehole operations involve the extreme impact forces and vibrational forces existing in a drill string application and resulting in excessive wear and fatigue to operating parts of the system. The particular difficulties encountered in a drill string environment, including the requirement for a long lasting system to prevent premature malfunction and replacement, require a simple and rugged valve system. Further, in drill string operations the inadvertent operation of the valve can substantially alter the flow characteristics of the normal drilling fluid circulation system to the extent that drilling operations would have to be halted in order to remove the malfunctioning device from the borehole. Accordingly, it is desirable to prevent the inadvertent operation of the pressure modulating valve to prevent false data signals and to prevent the valve from remaining open so that drilling operations can continue. In the case of the valve system disclosed in the present application, the system is arranged so that the valve remains closed in the event of a malfunction, thus preventing drilling fluids from being vented to the annulus and permitting normal drilling to continue.

The art has long sought a valve latch mechanism which is simple, yet durable, and operates rapidly and efficiently. The present invention overcomes the foregoing disadvantages and provides a new and improved mud pulse telemetry system having a latch device for controlling a modulating valve which is simple, durable, efficient, conveniently serviceable and not subject to inadvertent operation.

SUMMARY OF THE INVENTION

The present invention relates to a latch device for controlling a valve in a drilling fluid telemetry system. A fluid flow modulating valve is arranged so that disruptive vibrational forces and impact loads will aid in maintaining the valve in a latched or closed position. With the valve system disclosed herein, the modulating valve remains closed when subjected to disruptive vibrational forces and impact loads so that no drilling fluid is vented to the annulus and normal drilling continues. The invention includes a latching mechanism having a locking member for normally maintaining the modulating valve into an unoperated or closed condition. A selectively operable solenoid disengages the latching mechanism upon the occurrence of an electrical signal for operating the valve to produce a pressure pulse to modulate the drilling fluid flow.

One feature of the invention includes first and second engaging elements formed on the operating solenoid armature and the armature of the latching solenoid, respectively. The latching mechanism is normally urged into a position against the first and second engaging elements to hold the respective armatures from relative movement, thereby latching the valve in a closed position. Actuation of the opening solenoid simultaneously applies operating current to the latching solenoid to move the latching mechanism to the release position.

Another feature of the invention includes arrangement of the latching solenoid so that it moves more quickly than the valve opening solenoid even though both solenoids are simultaneously activated. The delay in the functioning of the valve opening solenoid permits the latching solenoid to release the latching mechanism so that the modulating valve is readily opened with the application of minimal force and the use of minimal energy.

These and other meritorious features and advantages of the present invention will be more fully appreciated from the following detailed description and claims.

BRIEF DESCRIPTION OF THE DRAWINGS

Other features and intended advantages of the invention will be more readily apparent by reference to the following detailed description in connection with the accompanying drawings wherein:

FIGS. 3 and 4 illustrate a valve latch mechanism for coupling the open/close solenoids to a latching solenoid; and FIGS. 5 and 6 illustrate an alternative latching mechanism for coupling the open/close solenoids to a latching solenoid.

While the invention will be described in connection with a presently preferred embodiment, it will be understood that it is not intended to limit the invention to that embodiment. On the contrary, it is intended to cover all alternatives, modifications and equivalents as may be included within the spirit of the invention as defined in the appended claims.

DESCRIPTION OF THE PREFERRED EMBODIMENT

Figure 1:
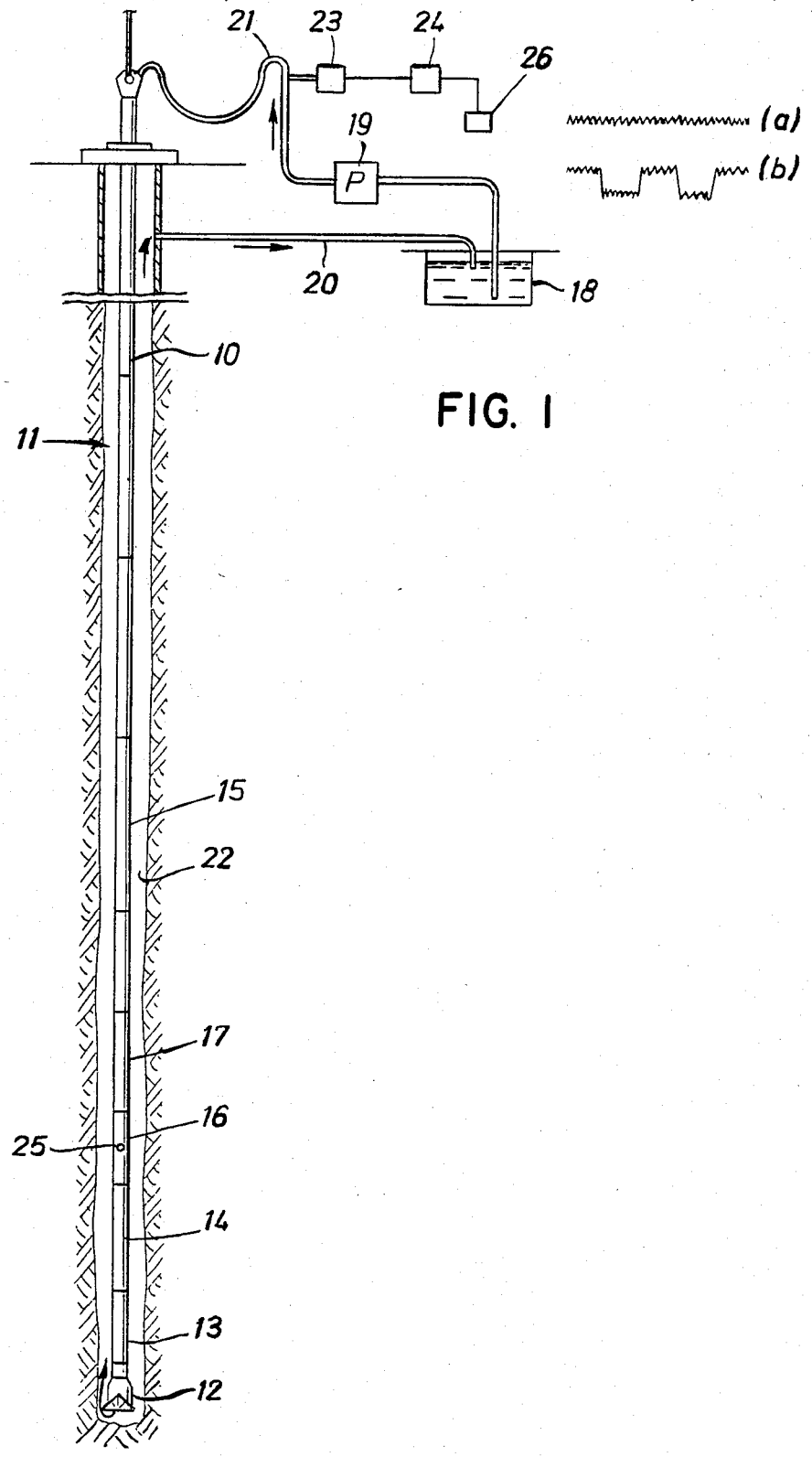
FIG. 1 is a schematic drawing of a drill string utilizing a pressure pulse valve system in accordance with the present invention and illustrating surface equipment for receiving telemetered data from downhole.

Referring first to FIG. 1 of the drawings, drill string 11 is schematically illustrated as including sections of drill pipe 10 suspended from a drilling platform at the surface and having drill collars 15 together with various downhole subassemblies at the bottom of the drill string. The downhole assembly includes bit 12 at its lower end, above which is located bit sub 13. Bit sub 13 often houses borehole parameter detecting instruments. Next in the string is illustrated power supply sub 14 and above that valve subassembly 16 which is the subject of the present invention. Instrument sub 17 houses associated electronics for encoding information indicative of detected data into a format which in turn drives valve 16 to impart data to the drilling fluid for telemetry to the surface. The drilling fluid or mud is circulated from storage pit 18 or the like at the surface by means of pump 19 to move the mud through stand pipe 21 into the drill string. The mud is carried through the string of hollow pipe comprising the drill string to the bottom of the borehole where it exits through the drill bit 12 carried on the bottom of the drill string. As the mud passes through bit 12, it experiences a substantial drop in pressure as it moves into the enlarged space of borehole annulus 22 surrounding the drill string. The mud then carries cuttings from the bottom of the borehole to the surface where they are removed and the mud is returned to pit 18 by pipe 20.

In a preferred embodiment, valve assembly 16 includes bypass passageway 25 which serves to connect the interior of the drill pipe fluid flow path with borehole annulus 22. A sufficient volume of mud can be vented through valve assembly 16 and passageway 25 to cause a modulation of the mud pressure. Transducer 23 is located in stand pipe 21 at the surface for detecting the modulations of pump pressure in order to receive data transmitted from downhole. The output of transducer 23 is decoded by surface electronics package 24 and the processed signals are passed to readout equipment 26. A schematic format of an analog readout is illustrated in FIG. 1 adjacent electronics package 24. The top line (a) illustrates the pressure fluctuations that typify the normal oscillating pressure drop observed across the drill bit. Line (b) illustrates the effect on surface pressure caused by venting fluid through valve 16 downhole. Simplistically, this describes a mud pulse telemetry system for utilizing the valve latch mechanism of the present invention in a drilling operation as will be set forth hereinafter in greater detail.

Generally, the valve latch mechanism of the present invention includes a valve operating means having a movable member for moving the valve means, latch means for preventing the movement of the movable member, means for selectively disengaging the latch means to permit movement of the movable member and a means for operating the selectively disengaging means.

Figure 2:
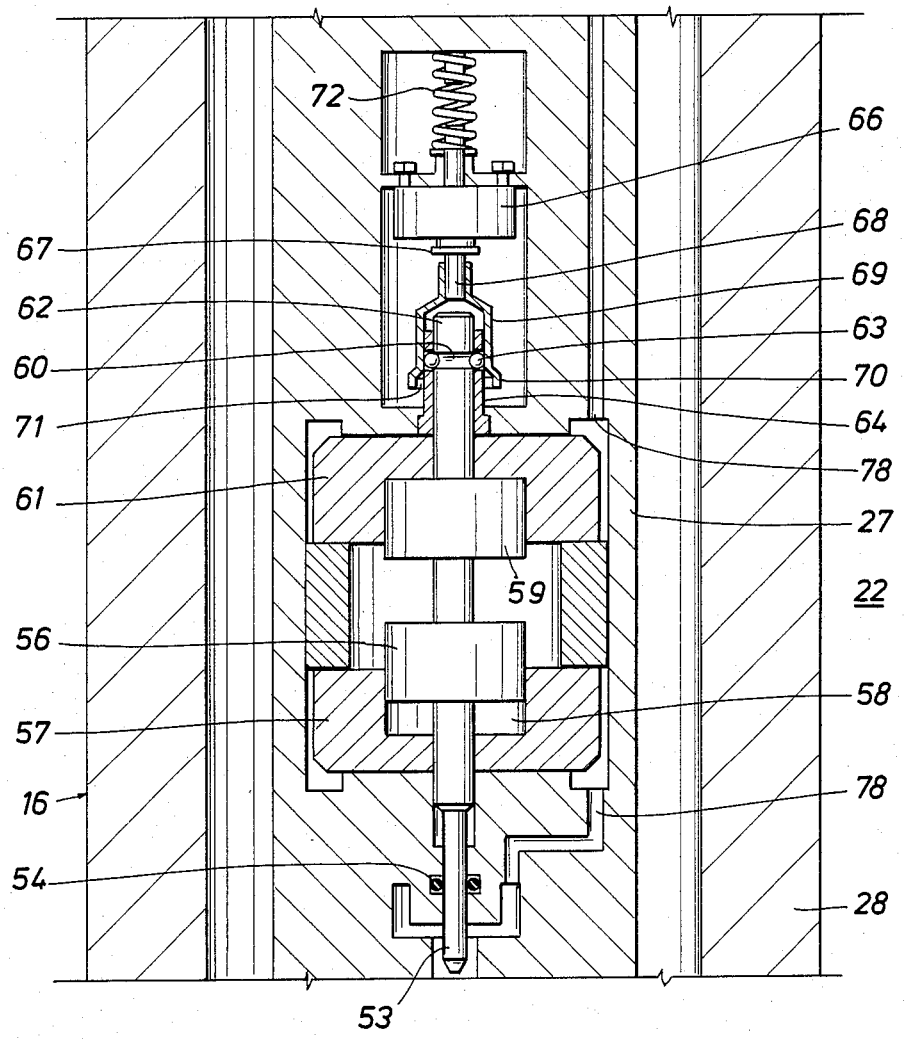
FIG. 2 is a cross-sectional elevation view of a valve latch mechanism in accordance with the present invention.

Referring now to FIG. 2 of the drawings, the valve latch assembly which forms the subject of this invention is located in housing 27 sized for positioning within the bore of drill collar or valve sub 16 having the dimensions of a drill collar. This assembly is then connected into drill string 11 as illustrated in FIG. 1. Solenoid stem 53 is attached at its lower end to a valve gate mechanism (not shown), e.g., a shear-type valve gate, which is capable of rapidly imparting a pulse to the mud flow through passageway 25 by simple movement of stem 53.

Stem 53 is vertically arranged in the body of housing 27 and has an "O" ring seal 54 positioned between stem 53 and the housing body. Stem 53 at its opposite end is connected to armature 56 of valve opening solenoid 57. Solenoid 57 is illustrated in FIG. 2 in the unactuated position with its armature spaced as at 58 from its closed position so that passageway 25 of FIG. 1 is closed.

Armature 56 of solenoid 57 is operatively connected to armature 59 of valve closing solenoid 61 so that the armatures move together as one unit. Upper end portion 62 of armature 59 which extends from the top side of solenoid 61 is illustrated having circumferential engagement groove 60 formed about the end portion for receiving one or more balls 63 in engagement in indented groove 60. The balls are housed in openings in ball retainer sleeve 64 attached to the solenoid body and thus held from movement by housing 27.

Spaced upwardly in housing 27 from solenoid 61 is third solenoid 66 referred to hereinafter as a latching solenoid. Latching solenoid 66 has depending armature assembly 67, illustrated in a gapped position. One embodiment of the latching solenoid arrangement is illustrated in greater detail in FIGS. 3 and 4 of the drawings. Armature stem 68 extending outwardly from armature assembly 67 has latch sleeve 69 attached to its far end by suitable means. The latch sleeve flares outwardly around the end of ball retainer 64. Annular upset portion 70 on latch sleeve 69 provides annular recess 71 on the interior of latch sleeve 69. Recess 71 is sized to receive balls 63 therein.

When sleeve 69 is moved to the left relative to ball retainer 64 as viewed in FIGS. 3 and 4, balls 63 are free to move into the recess 71. This in turn permits movement of armature end portion 62 and connected armatures 59 and 56 of solenoids 61 and 57, respectively. To the left of solenoid housing 66, armature 67 extends into contact with spring 72 for biasing armature 67 into an open solenoid position which, as illustrated in FIG. 4, confines balls 63 to groove 60 in end portion 62. In this position, the armatures of all the solenoids are latched from movement. In the operation of the solenoids, when an operating signal is applied to valve opening solenoid 57 (See FIG. 2), simultaneously therewith an operating signal is applied to the coil of solenoid 66 moving solenoid armature 67 against the normal biasing action of spring 72 and closing solenoid 66. This in turn moves latching sleeve 69 to the left to align annular recess 71 with balls 63. Simultaneously, solenoid 57 moves the unitary armature structure including end portion 62 to the right forcing ball 63 out of groove 60 laterally through holes 65 in ball retainer 64 and into annular recess 71 in annular upset portion 70. The unlatching action described above permits armature 56 and stem 53 to move downwardly (See FIG. 2) to open the pressure modulating valve assembly.

Should power to the solenoid systems described above fail for any reason, armature 67 of solenoid 66 is biased to the right by the action of spring 72 to hold latch sleeve 69 in the latch closed position of FIG. 4. In addition, should any vibrations occur in the drill string which would move the open/close solenoid armatures downwardly into an open valve position, this force will also act to move latching sleeve 69 down (to the right as viewed in FIG. 4). Movement of sleeve 69 to the right causes sloping surface 82 forming the interior wall of upset 70 to cam against balls 63 and further force the balls into latching engagement with groove 60. Thus, potential valve opening vibrational and impact forces on the pipe string tend to further fix the latching mechanism in its latching mode.

Now referring to FIGS. 5 and 6 of the drawings, an alternative valve latch mechanism is illustrated having substantially the same functional characteristics as the latch illustrated in FIGS. 3 and 4. However, balls 63 and ball retainer 64 are replaced by spring finger collets 86. The spring ends of collet fingers 86 have inward extending shoulders 87 forming a latch on the ends of fingers 86. Recessed portion 88 is formed near the end of end portion 62 and slopes gradually into the outer diameter of armature 59 of solenoid 61 by means of sloping surface 89. Again, solenoid armature 67 is biased to the open position by means of spring 72 which tends to force surface 82 to cam against the outer end of fingers 86 forcing the finger toward its latching position with latch 87 in groove 88.

Collets 86 have flanged end portion 91 on their other end which is received under collet retaining ring 92 to hold fingers 86 fixed relative to solenoid housing 61 and tool housing 27. The fixing of fingers 86 as well as ball retainer 64 (See FIGS. 3 and 4) to the tool housing permits the use of the potential vibrational valve opening action described above to actually aid in fixing the latching mechanism in the latched position. The vibrational movement forces balls 63 into grooves 60 or produces further latching of fingers 86 into recessed portion 88 on end portion 62 as illustrated in the embodiment of FIGS. 5 and 6.

In the typical operation of the system described above, the tool string shown in FIG. 1 is provided with one or more instruments or tools for detecting downhole parameters or the occurrence of downhole events. With any one of a number of detected events, the circuit components of the system provide a signal which because of its encoded position in a format of signals, is indicative of the occurrence of or value of a specific event. Thus, this signal is sent in the form of an electrical pulse of sufficient time duration to operate solenoid 57 to a solenoid closed position. Stem 53 is moved downwardly as viewed in FIG. 2 to align the valve gate (not shown) with the fluid passageway to permit fluid flow therethrough. The movement of the gate is sufficiently rapid so that a rapid release of drilling fluid occurs through passageway 25 of FIG. 1. This sudden flow though the valve openings permits drilling fluids under pump pressure in drill string 11 to be momentarily discharged into borehole annulus 22. The discharge of high pressure drilling fluids from the drill pipe into the low pressure annulus causes a rapid pressure drop in the column of mud in the drill pipe. When the valve has opened for a sufficient duration to provide a detectable pressure pulse, close valve solenoid 61 is operated to move the unitary solenoid armatures toward the valve closed position as illustrated in FIG. 2. The pressure drop is observable at the surface and is detected by transducer 23 in the mud standpipe as a negative pulse. Recordings of the pressure fluctuations seen at transducer 23, when format decoded by electronics 24, provide a readout at 26 directly indicative of the downhole detected event or value. (line (b) in FIG. 1).

When valve open solenoid 57 fires, a simultaneous signal is sent to latch solenoid 66 causing armature 67 to move to a closed position and moving latch sleeve 69 upwardly or to the left as viewed in FIGS. 3 and 4. This movement of latch sleeve 69 moves the recessed annular space 71 over balls 63 permitting the balls to move outwardly into recesses 71 out of annular groove 60 in armature end portion 62. This unlatching action permits the connected armatures 59 and 56 to move together and to open the valve assembly. In addition, solenoid 66 is arranged so that it has a faster response time than valve open solenoid 57. Therefore, even though solenoids 66 and 57 are activated electrically, simultaneously, solenoid 66 armature 67 moves a few milliseconds before armature 56, which in turn moves latch sleeve 67 into the unlatching position and thereby unlatches end portion 62 for movement of armature 56 and opening of the modulating valve. Otherwise, the spring 72 maintains a constant downward bias on armature 67 of latching solenoid 66 so that when the overriding action of solenoid 66 is not occurring, the latch will remain in the closed position as illustrated in FIG. 4 to hold the valve assembly in a valve closed configuration. The alternative embodiment of the latching mechanism illustrated in FIGS. 5 and 6 operates in the same fashion as described above with respect to FIGS. 3 and 4 except that the finger collets 86 and recess 88 form the latching mechanism.

The foregoing description of the invention has been directed primarily to a particular preferred embodiment in accordance with the requirements of the patent statutes and for purposes of explanation and illustration. It will be apparent, however, to those skilled in the art that many modifications and changes in the specifically described and illustrated apparatus may be made without departing from the scope and spirit of the invention. For example, while the disclosure of the system has been described primarily with regard to the specifically illustrated latch mechanisms of FIGS. 3–6, it will be appreciated from the present description and illustrations that other locking or latching arrangements, e.g., roller pins and appropriate grooves, may be substituted for the ball and groove arrangement of the preferred embodiment. Further, the present latch device may be used with any appropriate valve gate system. These and other changes may be made by those skilled in the art without departing from the present invention in its broadest aspects. Therefore, the invention is not restricted to the particular form of construction illustrated and described, but covers all modifications which may fall within the scope of the following claims.

It is Applicants' intention in the following claims to cover such modifications and variations as fall within the true spirit and scope of the invention.

What is claimed is:

1. A valve operating and latching apparatus suitable for use in a borehole drilling fluid telemetry system for transmitting data by imparting detectable pressure pulses to a drilling fluid circulating down the pipe string and up the borehole annulus wherein said pulses are imparted by operation of a valve for altering the flow of drilling fluids, comprising:

valve operating means having a movable member for moving a movable valve means for opening and closing a fluid flow path thereby modulating the flow of said drilling fluid;

latch means for preventing the movement of said movable member, wherein said latch means comprises first engagement means operably connected to said movable valve means;

second engagement means operably connected to a selectively operable disengaging means;

latch means positioned between said engagement means; and means normally biasing said second engagement means into a position forcing said latch means into latching engagement with said first engagement means to prevent said movable valve means from moving;

said means for selectively disengaging said latch means to permit movement of said movable member; and means for operating said selectively disengaging means.

2. The apparatus of claim 1 wherein said valve operating means is electrically operated and wherein said means for operating said selectively disengaging means is electrically operated.

3. The apparatus of claim 2 wherein an electrical signal is applied simultaneously to said valve operating means and to said selectively disengaging means.

4. The apparatus of claim 3 wherein said valve operating means responds more slowly to said electrical signal than said selectively disengaging means.

5. The apparatus of claim 4 wherein said valve operating means and said selectively disengaging means are both solenoids.

6. The apparatus of claim 1 further including means operable in response to the occurrence of a downhole event for operating said valve operating means.

7. The apparatus of claim 1 and further including means normally biasing said latch means into a position for preventing movement of said movable valve means.

8. The apparatus of claim 1 wherein said latch means is arranged to be fixed to the housing of a drill string member so as to prevent longitudinal movement of said latch means relative to said housing while permitting lateral movement of said latch means relative to said housing.

9. The apparatus of claim 8 wherein said latch means is arranged so that longitudinal vibration and impact loads on said drill string member move said latch means into an engaging position to reinforce means normally biasing said latch means into a position for preventing movement of said movable valve means.

10. The apparatus of claim 8 wherein said first and second engagement means are arranged to move in the same direction longitudinally with a greater degree of freedom than said latch means when vibrational and impact loads are applied to said drill string member.

11. The apparatus of claim 8 wherein said movable valve means is a shear type valve.

12. A valve apparatus suitable for use in a borehole drilling operation including a drill pipe string suspended in a borehole and circulating a drilling fluid through the drill pipe and borehole annulus for altering the flow of drilling fluids in the drill pipe, comprising:

valve means positioned in a member suitable for incorporation in a drill string, said valve means being operable to alter the flow characteristics of the drilling fluid stream in the drill pipe;

first selectively operable means having a movable member for moving the valve means into an open position;

second selectively operable means having a movable member for moving the valve means into a closed position, said movable members of said first and second selectively operable means being connected to operate as a unitary member;

means normally latching said unitary member from movement in one direction to maintain said valve means in one of said open or closed positions; and selectively operable means for deactivating said latching means.

13. The apparatus of claim 12 wherein said movable members are arranged to move longitudinally with respect to said drill string member and further wherein vibrational and impact loads on said drill string member urge said latching means to maintain said unitary member from movement.

14. The apparatus of claim 12 and further including a passage suitable for connecting the interior of said drill string member with a borehole annulus, wherein said valve means is positioned in the passage and is operable to vent drilling fluids from the bore of said drill string member into the annulus.

15. The apparatus of claim 14 wherein said valve means is a shear type valve.

16. The apparatus of claim 12 wherein said first and second selectively operable means and said selectively operable means for deactivating said latching means include solenoids for operating each of said selectively operable means.

17. A valve device suitable for use in a borehole drilling fluid telemetry system for transmitting data to the surface by imparting pressure pulses to a drilling fluid circulating down the pipe string and up the borehole annulus, wherein the drill string is subjected to vibrational and impact loads, comprising:

passage means in a member suitable for incorporation in said drill string for selectively passing a portion of the drilling fluid therethrough;

selectively operable valve means for controlling the flow of drilling fluid through said passage means;

valve operating means having a first movable member means for placing said valve in a position to generate a pulse in the drilling fluid stream;

engagement means on said first movable member means;

latch means for selectively engaging said first engagement means and for holding said first movable member means from movement when said latch means is engaging said engagement means;

latch operating means having a second movable member means for normally holding said latch means in a first position for engagement with said engagement means and movable to a second position for releasing said latch means from engagement with said engagement means; and selectively operable meas for moving said second movable member to said second position.

18. The apparatus of claim 17 wherein said latch means is arranged so that longitudinal vibration and impact loads on said drill string member move said latch means into an engaging position to reinforce means normally biasing said latch means into a position for preventing movement of said movable valve means.

19. The apparatus of claim 18 wherein said selectively operable valve means is a shear type valve.

20. A valve operating and latching apparatus suitable for use in a borehole drilling fluid telemetry system for transmitting data by imparting detectable pressure pulses to a drilling fluid circulating down the pipe string and up the borehole annulus wherein said pulses are imparted by operation of a valve for altering the flow of drilling fluids, comprising:

valve operating means having a movable member for moving a movable valve means for opening and closing a fluid flow path thereby modulating the flow of said drilling fluid;

latch means for preventing the movement of said movable member; and means for selectively disengaging said latch means to permit movement of said movable member, wherein said valve operating means and said means for selectively disengaging are both electrically operated by simultaneously applied electrical signals and wherein said valve operating means responds more slowly than said selectively disengaging means so that said latch means is disengaged before the movable member of said valve operating means is moved.

21. The apparatus of claim 20 wherein a single electrical signal is applied to both said valve operating means and to said selectively disengaging means.

22. The apparatus of claim 20 wherein said latch means is arranged so that longitudinal vibration and impact loads applied to said apparatus urge said latch means into an engaging position to reinforce means normally biasing said latch means into a position for preventing movement of said movable valve means.

23. A valve operating and latching apparatus suitable for use in a borehole drilling fluid telemetry system for transmitting data by imparting detectable pressure pulses to a drilling fluid circulating down the pipe string and up the borehole annulus wherein said pulses are imparted by operation of a valve for altering the flow of drilling fluids, comprising:

valve operating means having a movable member for moving a movable valve means for opening and closing a fluid flow path thereby modulating the flow of said drilling fluid;

latch means for preventing the movement of said movable member; and means for selectively disengaging said latch means to permit movement of said movable member, wherein said valve operating means and said means for selectively disengaging are electrically operated by a single electrical signal simultaneously applied to both said valve operating means and said means for selectively disengaging and wherein said latch means is disengaged before the movable member of said valve operating means is moved.

24. The apparatus of claim 23 wherein said latch means is arranged so that longitudinal vibration and impact loads applied to said apparatus urge said latch means into an engaging position to reinforce means normally biasing said latch means into a position for preventing movement of said movable valve means.

* * * * *